United States Patent [19]

Burkdoll et al.

[11] Patent Number: 4,664,033

[45] Date of Patent: May 12, 1987

[54] PYROTECHNIC/EXPLOSIVE INITIATOR

[75] Inventors: Frank B. Burkdoll, Vacaville; Harold W. Hannagan, Napa, both of Calif.

[73] Assignee: Explosive Technology, Inc., Fairfield, Calif.

[21] Appl. No.: 715,111

[22] Filed: Mar. 22, 1985

[51] Int. Cl.[4] ..... C06C 5/04; F42B 3/10

[52] U.S. Cl. ..... 102/275.2; 102/275.4; 102/275.6; 102/275.11; 89/1.14

[58] Field of Search ..... 102/275.2, 275.4, 275.5, 102/275.7, 275.8, 275.11, 275.12, 200, 483–485; 89/7, 27.13, 1.14

[56] References Cited

U.S. PATENT DOCUMENTS

| | | | |
|---|---|---|---|
| 3,129,663 | 4/1964 | Schnepfe | 102/275.4 |
| 3,326,127 | 6/1967 | Schimmel | 102/275.2 |
| 3,530,762 | 9/1970 | Batie et al. | 89/7 |
| 3,537,352 | 11/1970 | Joyce | 89/7 |
| 3,590,739 | 7/1971 | Persson | 102/275.5 |
| 3,628,272 | 12/1971 | Van Langenhoven | 89/7 X |
| 3,789,761 | 2/1974 | Travor | 102/275.4 X |
| 3,945,322 | 3/1976 | Carlson et al. | 102/275.4 |

*Primary Examiner*—David H. Brown

*Attorney, Agent, or Firm*—Flehr, Hohbach, Test, Albritton & Herbert

[57] ABSTRACT

Pyrotechnic/explosive initiator for use with a detonating cord or fuse comprising an elongated hollow tube with a longitudinally extending channel through which a gaseous percussion wave is propagated. The initiator includes a charge of pyrotechnic or explosive material and a valve for cutting off communication between the gas channel and the charge upon initiation of the charge to prevent gases and other reaction products from being exhausted back into the fuse.

15 Claims, 4 Drawing Figures

PYROTECHNIC/EXPLOSIVE INITIATOR

This invention pertains generally to explosive devices and more particularly to a detonator or ignitor for initiating an explosive or ignitive reaction.

U.S. Pat. No. 3,590,739 describes a fuse for transferring a detonation from one explosive charge to another without harm to objects in proximity to the fuse. This fuse comprises an elongated hollow tube having a coating of pyrotechnic material on the inner wall thereof which, when ignited, propagates a gaseous percussion wave at a velocity on the order of 1,500–2,000 meters/sec. Because of its relatively benign character, this fuse can be utilized in a wide variety of applications where other, more violent fuses cannot be employed. Such applications include, for example, rocket ignitors, inflaters for automotive air bags, aircraft escape systems, detonators, and other such devices where the fuse must pass in close proximity to humans or other objects which should not be damaged.

One problem with such fuses, however, is a tendency for gases or other reaction products to travel back up the hollow tube when a charge is detonated or ignited. This back travel is hazardous and can limit the applications in which the fuse is utilized.

It is in general an object of the invention to provide a new and improved detonator/ignitor for use with fuses of the aforesaid type.

Another object of the invention is to provide a detonator/ignitor of the above character which does not permit gases and other reaction products to travel back up the fuse from a charge which is detonated or ignited by the fuse.

These and other objects are achieved in accordance with the invention by providing an explosive or pyrotechnic initiator with a fuse having a longitudinally extending gas channel through which a gaseous percussion wave is transmitted. A charge of explosive or ignitive material adapted to be initiated by the percussion wave is positioned in communication with the gas channel. Pressure responsive valve means closes off communication between the channel and the charge upon initiation of the charge and prevents gases and other products produced by the charge from passing back into the gas channel.

Figure 1:
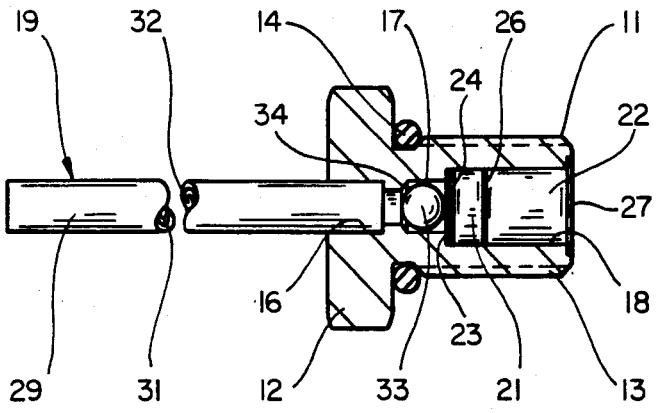
FIG. 1 is a centerline sectional view of one embodiment of a pyrotechnic pressure cartridge or gas generator according to the invention.

In the embodiment of FIG. 1, the pressure cartridge or gas generator comprises a generally cylindrical body 11 having a hexagonal nut or flange 12 toward one end thereof. The cylindrical body has an external thread 13, and it is adapted to be mounted in a threaded opening in a device (not shown) with which the pressure cartridge is to be employed. An O-ring packing 14 encircles the body at the base of the flange and assures a gas and moisture seal between the body and the other device. This particular device is particularly suitable for use in an aircraft canopy jettisoning system.

An axial bore having three sections 16–18 of progressively larger diameters extends through body 11. Section 16 forms an inlet port to which a fuse 19 is connected. Section 18 forms a chamber which contains a first-fire pyrotechnic material 21 and a pyrotechnic charge 22. A screen disc 23 and a paper disc 24 separate intermediate bore section 17 from chamber 18, a paper disc 26 separates the first-fire material from the propelling charge, and a disc 27 closes the outer end of chamber 18.

Fuse 19 is of the type described in U.S. Pat. No. 3,590,739. This fuse includes an elongated hollow tube 29 of flexible material, with a thin layer or coating 31 of an explosive or reactive material on the inner wall thereof. A gas channel extends longitudinally of the tube and carries a gaseous percussion wave sustained by an exothermic chemical reaction produced by detonation or ignition of the material lining the wall of the channel. Preferred explosives for coating 31 include pentaerythritoltetranitrate (PETN), cyclotrimethylenetrinitramine (RDX), cyclotetramethylenetetranitramine (HMX), trinitrotoluene (TNT), dinitroethylurea, tetryl, or a mixture of two or more of these substances.

First-fire material 21 comprises a metal/oxidant mixture or compound which is relatively easy to ignite. This material has a high thermal output and is suitable for initiating another material which is more difficult to initiate.

Pyrotechnic charge 22 comprises a nitrocellulose based propellant powder or other gas producing pyrotechnic compound such as boron/potassium nitrate ($B/KNO_3$).

Valve means is provided for closing off communication between inlet port 16 and chamber 18 to prevent gases and other reaction products from being exhausted back through the gas channel in fuse 19. This means comprises a spherical valve member or ball 33 positioned loosely within bore section 17 and a conical or spherical valve seat 34 formed at the junction of bore sections 16 and 17 facing the explosive charge. Ball 33 is of smaller diameter than bore section 17 and is received in sealing engagement with valve seat 34 when urged against the seat. Ball 33 and seat 34 can be fabricated of any suitable materials. For example, the ball and the seat can both be fabricated of metal or a resilient plastic material, or the ball can be metallic, and the seat can be fabricated of a resilient material such as plastic. Likewise, the ball can be fabricated of plastic, and the seat can be fabricated of metal. Suitable metals for the ball and seat include aluminum, brass, copper, and stainless steel. Suitable materials for a resilient ball and seat include Teflon and polypropylene.

Operation and use of the embodiment of FIG. 1 is as follows. The pyrotechnic material in fuse 19 is initiated by a detonating cap (not shown) at the proximal end of the fuse. The resulting percussion wave propagates through gas channel 32 and passes through bore section 17, igniting first-fire material 21. This material ignites the propellant charge 22, which begins to burn. The gas pressure within chamber 18 increases rapidly, driving ball 33 into sealing engagement with seat 34, thereby closing off communication between chamber 18 and gas channel 32. This prevents gases and other reaction products from being exhausted back through the fuse.

Figure 2:
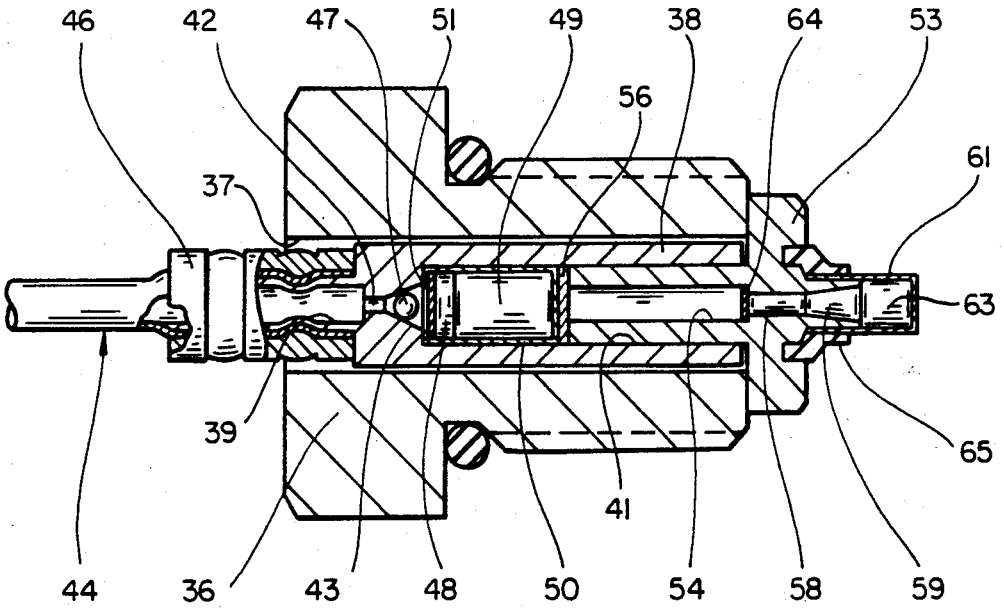
FIG. 2 is a centerline sectional view of one embodiment of a detonator according to the invention.

In the embodiment of FIG. 2, the detonator has a threaded retainer body 36 which is generally similar to body 11. Body 36, however, has an axial bore 37 of uniform diameter in which an inner body 38 is mounted. Body 38 has an inlet port 39 toward one end thereof, a chamber 41 of increased diameter toward the other end, and a passageway 42 and a conical bore 43 providing communication between the inlet port and the chamber. A fuse similar to fuse 19 is connected to the inlet end of body 38 by a swaged ferrule 46 with the gas channel in the fuse in direct communication with inlet port 39.

A spherical ball or valve member 47 is positioned within conical bore 43. The ball is of a diameter such that it fits loosely within the bore until gas pressure from chamber 41 urges it into sealing engagement with the wall of the bore.

A first-fire pyrotechnic material 48 and a charge of secondary explosive 49 such as hexanitrostilbene (HNS) or hexanitroazobenzene (HNAB) are carried by a cartridge 50 positioned within bore 41. A screen disc 51 positioned at the open end of the cartridge at the junction of conical bore 43 and chamber 41 retains the first-fire material in the chamber.

A plug 53 having an axial bore 54 is mounted in the outer end of chamber 41. A flyer disc 56 is mounted in chamber 41 and abuts against the inner end of plug 53 and the propelling cartridge 50.

A second axial bore 58 communicates with bore 54 within plug 53, and a charge 59 of secondary explosive is contained within bore 58. An end cup 61 is affixed to the outer end of plug 53, and a charge 63 of secondary explosive is contained within this cup. Charge 59 is retained in bore 58 by a tape disc 64. An elastomeric seal 65 provides a moisture barrier during installation of the detonator in an appropriate port.

Operation and use of the embodiment of FIG. 2 is as follows. Ignition of the pyrotechnic material within fuse 44 ignites first-fire material 48 which, in turn, ignites secondary explosive 49. The gas pressure produced by the ignition of the secondary explosive drives ball 47 into sealing engagement with valve seat 43, cutting off communication between chamber 41 and the gas channel within the detonating fuse. The build up of pressure within chamber 41 also causes the central portion of the flyer disc 56 to shear off and be propelled down bore 54. When the disc impacts upon secondary explosive 59, this secondary explosive detonates, initiating secondary explosive 63 to boost the output energy level.

Figure 3:
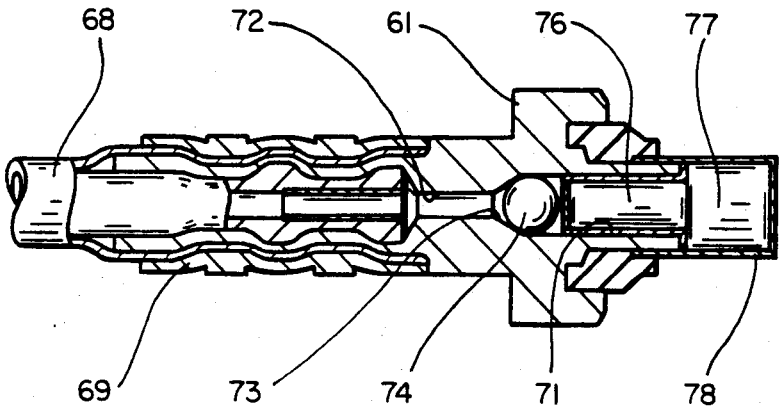
FIG. 3 is a centerline sectional view of another embodiment of a detonator according to the invention.

The embodiment of FIG. 3 is generally similar to the embodiment of FIG. 2, except it does not include the propelling cartridge 50 and flyer disc 56, depending instead upon the detonation of the primary explosive charge 76 to detonate an output booster charge. This embodiment includes a body 67 adapted to be mounted in the axial bore of an outer threaded retainer body similar to body 36. A fuse 68 similar to fuse 19 is secured to one end of body 67 by a swaged ferrule 69, and a chamber 71 is formed toward the other end of body 67.

A charge 76 of primary explosive such as lead azide is contained within bore 71, and a charge 77 of secondary explosive is contained in a cup 78 secured to the distal end of body 67.

Operation and use of the embodiment of FIG. 3 is generally similar to that of the previous embodiments. The percussion wave from fuse 68 initiates the primary explosive 76, and the gas produced by this reaction forces ball 74 into sealing engagement with seat 73. The primary charge, in turn, detonates the secondary charge 77.

Figure 4:
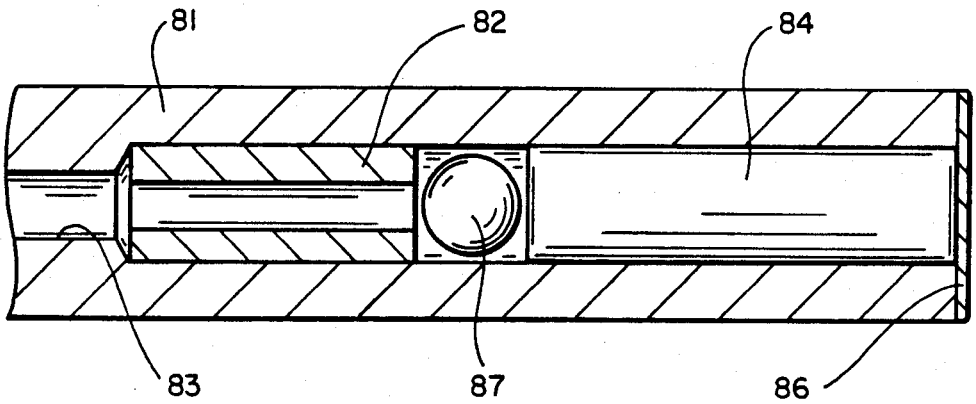
FIG. 4 is a centerline sectional view of one embodiment of an ignitor according to the invention.

The embodiment of FIG. 4 includes an elongated fuse 81 similar to fuse 19. A short cylindrical sleeve 82 is mounted in the gas channel 83 of the fuse toward the distal end of the fuse. The sleeve is fabricated of a rigid material, and the diameter of the sleeve is such that the outer wall of the sleeve is in sealing engagement with the inner wall of the fuse.

A charge of pyrotechnic material 84 is positioned in channel 83 between sleeve 82 and the distal end of the tube. This material can, for example, be of the ignitive type disclosed in U.S. Pat. No. 4,220,087. That patent discloses an ignition fuse having an elongated core of ignitive, non-detonative material comprising a mixture of a particulate fuel having a high heat of combustion and an oxidant such as a compound of aluminum powder and potassium perchlorate. Alternatively, a high output gas producing compound such as a double-based nitrocellulose propellant can be used for the ignitive element 84. The distal end of tube 81 is closed by a disc 86 affixed to the tube.

Charge 84 is spaced from the distal end of sleeve 82, and a spherical valve member or ball 87 is positioned in the space between the charge and the sleeve. The ball has a diameter greater than the inner diameter of the sleeve and less than the outer diameter of the sleeve, and prior to initiation the ball is loosely retained between the sleeve and the ignitive charge.

Operation and use of the embodiment of FIG. 4 is as follows. The percussion wave from fuse 81 ignites ignitive charge 84, producing a violent ignitive reaction. Gases produced by this reaction drive ball 87 into sealing engagement with the distal end of sleeve 82, thereby cutting off communication between charge 84 and the remainder of fuse 81. As in the other embodiments, this closure prevents the gases and other reaction products from being exhausted back through the gas channel in the fuse.

While the invention has been described with specific reference to a spherical valve member, the valve member and seat can be of any suitable shape or configuration such as conical or planar.

It is apparent from the foregoing that a new and improved initiator has been provided. While only certain presently preferred embodiments have been described in detail, as will be apparent to those familiar with the art, certain changes and modifications can be made without departing from the scope of the invention as defined by the following claims.

We claim:

1. In a pyrotechnic/explosive initiator: a fuse having a longitudinally extending gas channel through which a gaseous percussion wave is transmitted, a charge of pyrotechnic explosive material positioned in communication with the gas channel and adapted to be initiated by the percussion wave, and valve means responsive to gas pressure produced by initiation of the charge for closing off communication between the charge and the gas channel to prevent gas produced by the charge from passing into the channel.

2. The initiator of claim 1 wherein the fuse comprises an elongated hollow tube with a coating of pyrotechnic material on the inner wall of the tube.

3. The initiator of claim 1 wherein the valve means comprises a seat which faces the charge and a movable valve member positioned between the seat and the charge.

4. The initiator of claim 3 wherein the valve member comprises a spherical ball.

5. The initiator of claim 3 wherein one of the valve member and the seat is fabricated of a resilient material, and the other is fabricated of a rigid material.

6. In a pyrotechnic/explosive initiator for use with a fuse having a longitudinally extending gas channel through which a percussion wave is transmitted: a body having an inlet port to which the fuse is connected, a chamber within the body in communication with the inlet port, a charge of pyrotechnic/explosive material in the chamber which is initiated by the percussion wave from the fuse, and gas pressure responsive valve means for closing off communication between the inlet port and the chamber upon initiation of the charge.

7. The initiator of claim 6 wherein the charge comprises a primary explosive material initiated by the percussion wave and a secondary explosive material initiated by ignition of the primary explosive material.

8. The initiator of claim 6 including a bore which extends from the chamber, and an impactor disc positioned toward one end of the bore and adapted to be propelled through the bore by ignition of the charge, and a second charge of explosive material positioned toward the other end of the bore for detonating impact by the disc.

9. The initiator of claim 6 wherein the charge comprises a first-fire pyrotechnic material which is initiated by the percussion wave, and a gas producing pyrotechnic material which is initiated by the first-fire material.

10. The initiator of claim 6 wherein the valve means comprises a seat which faces the chamber and a movable member positioned between the seat and the chamber.

11. The initiator of claim 10 wherein the valve member comprises a spherical ball.

12. The initiator of claim 10 wherein one of the valve member and the seat is fabricated of a resilient material, and the other is fabricated of a rigid material.

13. In an ignitor: a fuse comprising an elongated hollow tube with a coating of pyrotechnic material on the inner wall thereof, a generally cylindrical sleeve mounted within the bore of the tube toward the distal end thereof with the outer wall of the sleeve in sealing engagement with the inner wall of the tube, a charge of ignitive material spaced from the sleeve toward the distal end of the tube, and a valve member positioned between the sleeve and the charge and being urged into sealing engagement with the sleeve by gases produced by ignition of the charge.

14. The ignitor of claim 13 wherein the valve member comprises a spherical ball, and the ignitive charge is spaced from the sleeve by a distance greater than the diameter of the ball.

15. The ignitor of claim 13 wherein the ignitive charge comprises a mixture of an oxidant and a particulate fuel having a high heat of combustion.

* * * * *